US008347597B2

(12) United States Patent
Schermer et al.

(10) Patent No.: US 8,347,597 B2
(45) Date of Patent: Jan. 8, 2013

(54) THREAD DRAW-OFF NOZZLE

(75) Inventors: Josef Schermer, Bergheim-Unterstall (DE); Edmund Schuller, Ingolstadt (DE)

(73) Assignee: Rieter Ingolstadt GmbH, Ingolstadt (DE)

( * ) Notice: Subject to any disclaimer, the term of this patent is extended or adjusted under 35 U.S.C. 154(b) by 0 days.

(21) Appl. No.: 13/166,919

(22) Filed: Jun. 23, 2011

(65) Prior Publication Data

US 2011/0315265 A1 Dec. 29, 2011

(51) Int. Cl.
*D01H 4/08* (2006.01)

(52) U.S. Cl. ..... 57/417

(58) Field of Classification Search ..... 57/404, 57/417

See application file for complete search history.

(56) References Cited

U.S. PATENT DOCUMENTS

| | | | | |
|---|---|---|---|---|
| 3,640,061 A | | 2/1972 | Landwehrkamp | |
| 3,834,147 A | | 9/1974 | Havranek et al. | |
| 5,265,406 A | | 11/1993 | Hofmann et al. | |
| 5,437,147 A | * | 8/1995 | Mackey et al. | 57/417 |
| 5,475,974 A | * | 12/1995 | Mackey et al. | 57/417 |
| 5,638,671 A | * | 6/1997 | Stahlecker et al. | 57/417 |
| 5,675,965 A | * | 10/1997 | Mackey et al. | 57/417 |

FOREIGN PATENT DOCUMENTS

| | | |
|---|---|---|
| DE | 29 16 089 | 10/1979 |
| DE | 102 22 635 A1 | 12/2003 |
| DE | 10 2005 045 817 A1 | 5/2006 |
| WO | WO 94/04730 | 3/1994 |

OTHER PUBLICATIONS

German Patent Office Search Report, Dec. 21, 2010.

* cited by examiner

*Primary Examiner* — Shaun R Hurley
(74) *Attorney, Agent, or Firm* — Dority & Manning, P.A.

(57) ABSTRACT

A thread draw-off nozzle (1) for an open-end spinning device has a draw-off nozzle funnel (6) that contains a yarn deflection zone (3) for deflecting a yarn (5) produced during the yarn draw-off process. The draw-off nozzle funnel (6) has a two-part design, an external part (6*a*) containing a first area (3*a*) of the yarn deflection zone (3) and an internal part (6*b*) containing a second area (3*b*) of the yarn deflection zone (3). Both parts (6*a*, 6*b*) are made of different materials and/or have different coatings at least in the areas (3*a*, 3*b*) of the yarn deflection zone (3) or only one of the two parts (6*a*, 6*b*) has a coating.

14 Claims, 2 Drawing Sheets

THREAD DRAW-OFF NOZZLE

FIELD OF THE INVENTION

This invention refers to a thread draw-off nozzle for an open-end spinning device with a draw-off nozzle funnel that contains a yarn deflection zone for deflecting a yarn produced during the yarn draw-off process.

Many different state-of-the-art designs of thread draw-off nozzles for open-end spinning devices are known. In them, the thread draw-off nozzles are secured in a thread draw-off channel of the open-end spinning device and serve to guide and deflect the yarn produced in the spinning rotor during the thread draw-off process. The uninterrupted contact with the yarn that is being pulled over the thread draw-off nozzle generates a great deal of heat in the thread draw-off nozzle during operation, especially with high rotor speeds and therefore high draw-off speeds. If this heat is not sufficiently dissipated, the high temperatures can damage the yarn and cause breaks in the thread. Likewise, draw-off nozzles can get dirty and, on the other hand, the continuous running of the thread over the draw-off nozzle makes it necessary to manufacture draw-off nozzles from a wear-resistant material.

Thread draw-off nozzles in which the draw-off nozzle funnel is made of one single piece of metallic material are known. In this case, very good heat dissipation in the surface of the thread draw-off funnel is achieved, but this requires the materials to be coated with a wear-resistant coating. Such coatings, however, can only be deposited on a smooth surface and in quite accessible areas as a uniform layer with sufficient thickness. In areas with macro structures (such as notches or spirals) and in the nozzle bore hole, however, coatings are only insufficiently developed so these areas can be subject to considerable wear. In addition, irregularities in the coated surface can damage the yarn.

In order to also improve nozzle wear resistance in these areas, EP 0 445 554 B1 suggests executing a main body of the thread draw-off nozzle from a heat-conducting, metallic material and to insert a nozzle funnel made from an wear-resistant ceramic material in the main body. Owing to the comparatively poor thermal conductivity of the ceramic material, it is nonetheless possible for heat to be insufficiently dissipated from the nozzle funnel surface and therefore cause overheating.

DE 10 2005 045 817 A1 also shows a thread draw-off nozzle with a wear-resistant ceramic nozzle funnel. To improve the dissipation of heat in the nozzle main body, the patent application suggests forming the nozzle funnel with the nozzle main body in a directly thermally conductive way, for example by pouring in. Nonetheless, the surface of the nozzle funnel that makes contact with the drawn-off yarn can still reach very high surface temperatures. Thus, rotor speeds are frequently limited by the thermal load present in the draw-off nozzle.

The task of this invention is therefore to suggest a thread draw-off nozzle that further improves the heat dissipating from the nozzle funnel surface that touches the thread.

SUMMARY

Additional objects and advantages of the invention will be set forth in part in the following description, or may be obvious from the description, or may be learned through practice of the invention.

In a particular embodiment, a thread draw-off nozzle for an open-end spinning device has a draw-off nozzle funnel with a yarn deflection zone for deflecting the yarn produced while the yarn is being drawn off. According to one embodiment, the draw-off nozzle funnel is executed in two parts, its external part containing the first area of the yarn deflection zone and its internal part containing the second area of the yarn deflection zone. Both parts are made of different materials and/or have different coatings at least in the areas of the yarn deflection zone. According to another favorable design, however, only one of the two parts is coated, while the other part remains uncoated. Whereas in the state of the art a fully ceramic draw-off nozzle funnel was inserted in the draw-off nozzle, the two-part design of the draw-off nozzle funnel makes it possible to optimally equip and protect the draw-off nozzle funnel according to the loads present in the individual areas of the yarn deflection zone and according to the thermal conductivity requirements of the individual areas. Appropriate material selection can improve heat dissipation from the yarn deflection zone and a coating can only be applied in a spot where it is absolutely needed for preventing wear.

A transition spot between the external and internal part outside of the yarn deflection zone with respect to the thread guiding surface can be arranged in a set back manner to prevent possible burs, projections or notches from making contact with the yarn and damage it.

The applicant has determined that, especially in the outer area of the nozzle funnel where the high circumferential speed of the drawn-off yarn leads to high frictional energy, very high surface temperatures and localized overheating occur. The invention therefore provides for the external part of the draw-off nozzle funnel to be made preferably of a material, a metal if possible, that conducts heat very well because this area needs more thermal conductivity. Suitable wear-protecting coatings can nonetheless provide sufficient protection to the external part of the draw-off nozzle funnel.

The internal part, which is under lower thermal stress owing to the lower yarn circumferential speed, is made (according to a favorable embodiment) of a highly wear-resistant material and/or has a highly wear-resistant coating. The internal part is preferably made of a wear-resistant ceramic material and since only the internal part of the draw-off nozzle funnel is made of the ceramic material, heat can dissipate well to the draw-off nozzle or the surroundings in spite of the comparatively poor heat conductivity of the ceramic material. At the same time, the execution of the internal part of the nozzle funnel with a ceramic material allows the inclusion of structures such as notches or spirals. The execution of a two-part draw-off nozzle funnel according to certain aspects of the invention makes it possible to optimally combine the demands made on wear resistance and heat dissipation and to significantly improve the dissipation of heat from the external part of the draw-off nozzle funnel.

Another advantage of the present embodiments of the thread draw-off nozzle is a nozzle holder and/or draw-off nozzle shaft for mounting the draw-off nozzle to the spinning device. If the draw-off nozzle has been intended as a shaft-free nozzle, then the nozzle holder is mounted to the spinning device with one or several mounting devices like magnets.

It is especially advantageous for the external part of the draw-off nozzle funnel, the nozzle holder and/or the draw-off nozzle shaft to be executed together as one single piece to form a nozzle main body. This design would dissipate heat from the draw-off nozzle funnel even better because no opening or insulating layers between the external part of the draw-off nozzle funnel and the draw-off nozzle shaft would need to be overcome. In addition, manufacturing would be simplified.

Another advantageous design of the invention foresees the internal part to be executed as a ceramic insert for inclusion in the external part and/or in the nozzle holder. This facilitates the mounting of the individual parts of the draw-off nozzle and the fastening of the internal part.

So heat can be effectively dissipated from the yarn deflection zone and emitted to the surroundings of the thread draw-off nozzle, the external part of the draw-off nozzle funnel and/or of the draw-off nozzle is/are made of a material having a minimum thermal conductivity of 100 W/mK. Aluminum, copper and their alloys are especially suitable for this purpose, as they can be easily processed.

So that apart from good heat dissipation, sufficient wear resistance can nonetheless be achieved in the external part of the draw-off nozzle funnel if it is coated with a wear-resistant coating at least in the yarn deflection zone. It is particularly advantageous for the wear-protection coating to have high thermal conductivity because heat dissipation from the surface of the draw-off nozzle funnel can be ensured in spite of the improved wear protection. To improve heat dissipation even more, the wear-protective layer should preferably be thin.

If the draw-off nozzle funnel and the draw-off nozzle shaft are executed as one single piece, then it would be preferable for the nozzle main body to be coated with a wear-protective layer with high thermal conductivity. As a result of this, not only the especially stressed yarn deflection zone in the external part of the draw-off nozzle funnel, but also all surfaces of the draw-off nozzle that can touch the yarn can be protected against wear.

According to an especially advantageous execution of the invention, the wear-protective layer is a hard material or diamond coating. In this case, the hard material or diamond coating can also be electroplated or use a PVD or CVD process. An example of a diamond coating can be an electroplated nickel-phosphorous-diamond coating. Likewise, a DLC (diamond-like carbon) coating that can be applied using a PVD or CVD process should also be considered, owing to its high thermal conductivity and that it can also be conveniently applied as a very thin layer. The DLC coating has nonetheless the needed hardness and wear resistance.

According to another advantageous embodiment of the invention, the ceramic insert has radially arranged notches or spirals for influencing the guidance and uncoiling of the thread. The two-part design of the draw-off nozzle funnel makes it optimally possible to attach the desired macro structures onto the nozzle funnel surface with improved heat dissipation and with wear-resistant execution. In a one-part metallic nozzle funnel, on the other hand, it is almost impossible to achieve sufficient wear protection in the area of such macro structures because coatings cannot be uniformly applied on a surface having such structures. A one-part ceramic nozzle funnel, on the other hand, has the needed wear resistance in the area of such surface structures but offers only limited heat dissipation. The two-part design of the draw-off nozzle funnel has the advantage that the execution of the macro structures as well as the radius and length of the draw-off nozzle funnel can be changed. With the two-part design according to the invention that includes a ceramic insert, which forms the internal part of the nozzle funnel, good heat dissipation is achieved with maximum wear protection and free surface design.

Especially advantageous is also if a wear-protection bushing made of steel or ceramic is arranged on the draw-off nozzle funnel in the thread draw-off nozzle because comparatively little heat is generated in this internal area of the draw-off nozzle so that the latter can also be made from a relatively poor heat conducting ceramic material. The wear-protection bushing can, however, also be made conveniently of a hardened steel part or one with a wear protective coating.

According to an especially advantageous execution of the invention, the ceramic insert is made as one single piece with the wear-protective bushing for simplifying the manufacturing of the draw-off nozzle because now only one part must be operated. Especially if the draw-off nozzle funnel and the draw-off nozzle shaft are designed as one single part with such one-part ceramic insert, the manufacturing of the draw-off nozzle and heat dissipation are improved because there is better heat-conducting contact.

It is furthermore advantageous for the ceramic insert to be glued or pressed in. Because the two-part design achieves very good heat dissipation from the thermally stressed yarn deflection zone in the external part of the nozzle funnel, no unfavorable insulating effects are caused by the pasting on of the ceramic insert and the manufacturing of the thread draw-off nozzle is simplified.

BRIEF DESCRIPTION OF THE DRAWINGS

Additional advantages of the invention are described with the help of the embodiments shown below, which show.

DETAILED DESCRIPTION

Figure 2:
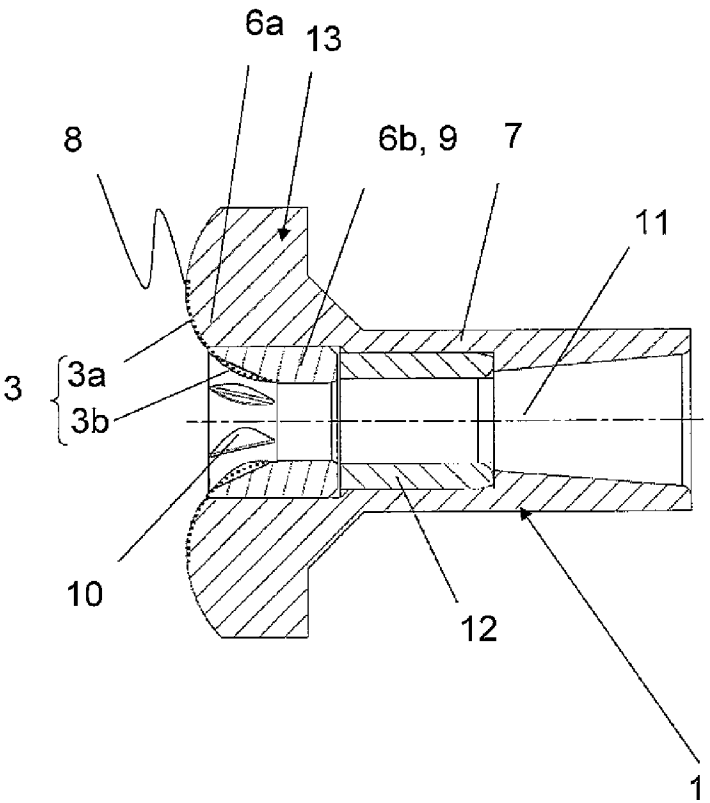

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

Figure 1:
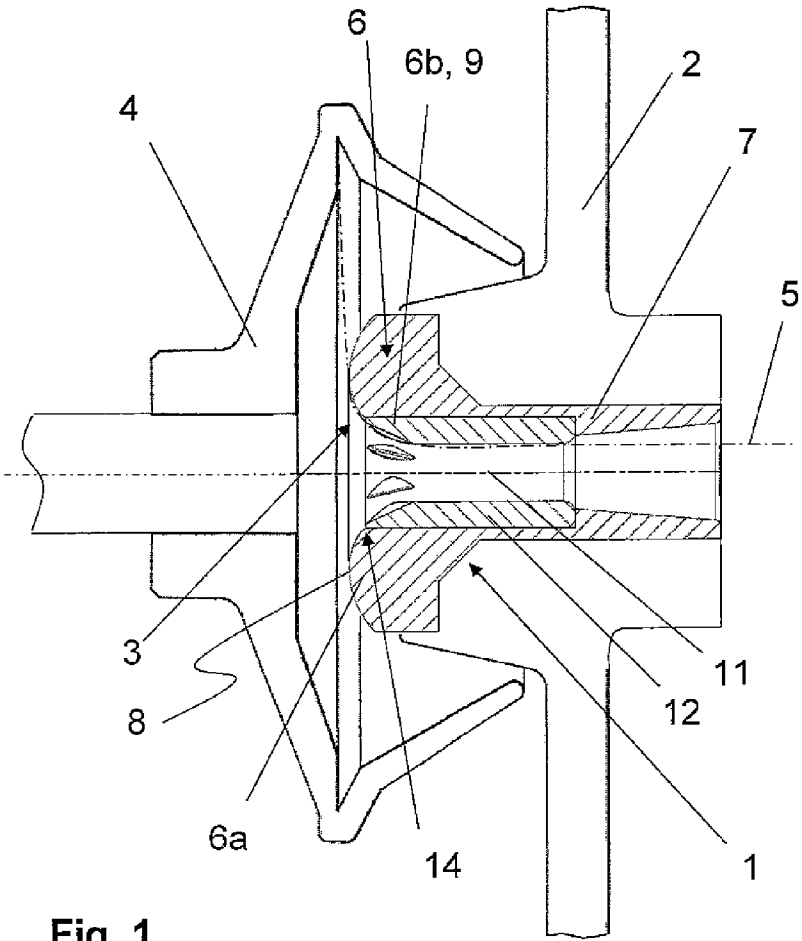
FIG. 1 a first embodiment of a thread draw-off nozzle mounted onto a open-ended spinning device, and FIG. 2 another embodiment of a thread draw-off nozzle according to the invention, FIG. 3 another embodiment of a thread draw-off nozzle according to the invention as a shaft-less nozzle, and FIG. 4 another embodiment of a thread draw-off nozzle according to the invention with a separate nozzle holder.

FIG. 1 shows a thread draw-off nozzle 1 according to the invention that is mounted in a known manner onto a cover 2 of a rotor housing (not shown here) of an open-end spinning machine. The draw-off nozzle 1 serves for deflecting and guiding the yarn 5 produced in the spinning rotor 4, in this case indicated merely by a segmented line. Here, the spinning rotor 4 runs with speeds of up to 150,000 rpm and the produced yarn 5 is drawn off with speeds of 250 meters per minute, for example. Owing to the rotation of the rotor 4, the yarn 5 runs together in a rotating way in a crank-like manner along the surface of the draw-off nozzle 1.

The draw-off nozzle 1 consists here of a draw-off nozzle funnel 6, on which the yarn 5 is deflected, and of a draw-off nozzle shaft 7 with which the draw-off nozzle 1 is fastened to the cover 2 of the spinning device. Because the drawn-off yarn 5 is in constant contact with the crank-like revolving yarn 5 being drawn off at a high speed, friction generates a lot of heat on the surface 8 of the draw-off nozzle funnel 6. In addition, this area of the draw-off nozzle funnel 6 in particular is subject to significant wear due to the constant yarn movement.

For this reason, technologically advanced draw-off nozzle funnels 6 are typically made from a highly wear-resistant ceramic material but the disadvantage of such ceramic materials is their comparatively poor heat conductivity lower than 30 W/mK so the enormous amount of heat generated by the drawn-off and the rotating thread is insufficiently dissipated. Therefore, and particularly in the processing of thermally sensitive chemical fibers, open-end spinning devices must be operated at reduced speeds in the state of the art to prevent such overheating, although higher rotor speeds and draw-off speeds could be possible from the purely engineering aspect.

The invention has now found out that when the external area of the nozzle funnel 6 has a larger diameter, a significant rise in temperature occurs owing to the higher circumferential speed of the yarn and the used ceramic materials are unable to sufficiently dissipate this generated heat. The rise in temperature is further intensified by the particularly smooth surface in the area of the yarn deflection zone 3 (see FIGS. 2 & 4) and the constant contact of the yarn 5 in this area. The invention therefore suggests executing the draw-off nozzle funnel 6 as two parts, each one containing an area 3*a* & 3*b* of the yarn deflection zone 3. The external part 6*a* of the draw-off nozzle funnel 6 is made preferably of a metallic material having a high thermal conductivity whenever possible so it can optimally dissipate the heat from the surface 8 of the draw-off nozzle funnel 6 to the surroundings, in this case the draw-off nozzle shaft 7 and the cover 2. The internal part 6*b*, on the other hand, is made of a material highly resistant to wear, especially ceramic, executed here as a ceramic insert 9. This allows the draw-off nozzle 1 to be made in an especially wear-resistant way and nonetheless influence the movement of the yarn 5 sweeping above through various structures such as notches 10 or spirals. Thanks to the design of a thread draw-off nozzle 1 with a two-part draw-off nozzle funnel 6 according to the invention, it is possible to combine optimally the demands made to wear resistance and the best possible yarn influence with outstanding heat dissipation to achieve improved spinning results. With this design, dirt in the thread-guiding surfaces of the draw-off nozzle funnel 6 that can lead to thread breakage and damage of the yarn 5, especially in the processing of chemical or synthetic fibers can be prevented. The much better heat dissipation in the external part 6*a* of the draw-off nozzle funnel prevents overheating from occurring so the rotor speeds is no longer limited by the temperatures in the draw-off nozzle 1.

Figure 3:
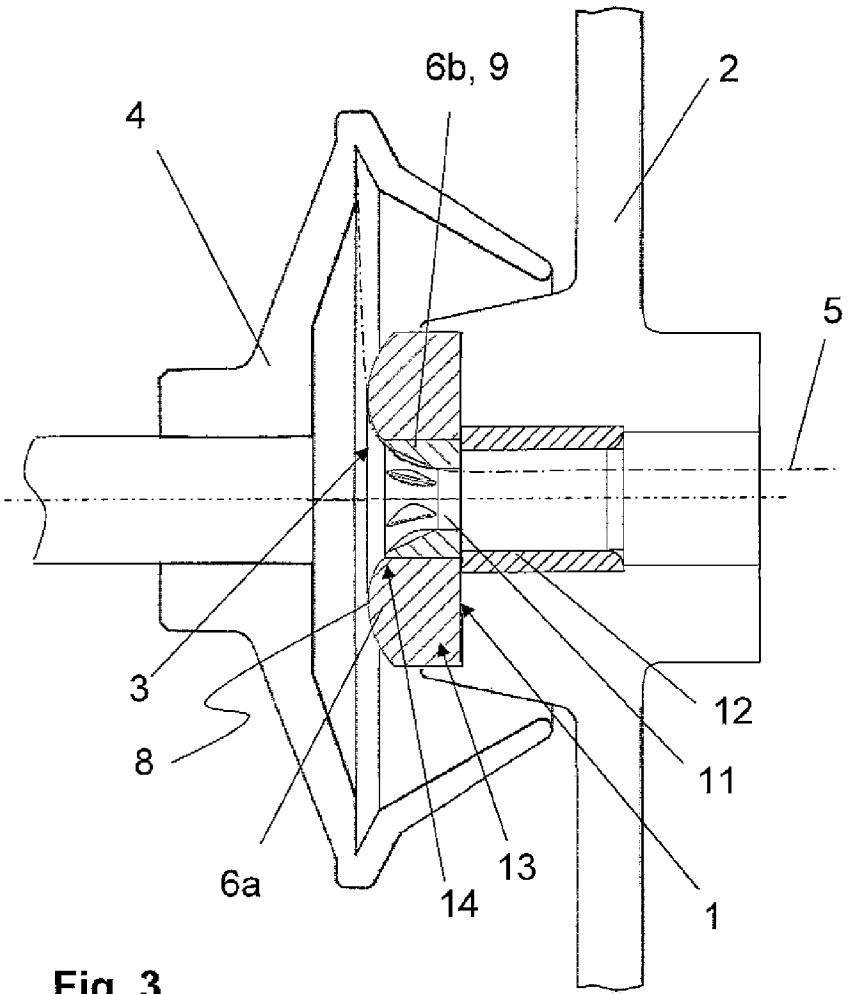

As can be seen in FIGS. 1 and 3, in this case the transition spot 14 between the external part 6*a* and the internal part 6*b* is arranged in a somewhat set back manner from the surface 8 of the draw-off nozzle funnel 6 and consequently outside of the yarn deflection zone 3. Damages of the yarn 5 running above caused by protruding burs or other irregularities of the surface 8 in this area can thus be prevented.

According to FIG. 1, the external part 6*a* of the draw-off nozzle funnel 6 and the draw-off nozzle shaft 7 are executed together as one part and made of a heat conductive material. This improves heat conductivity, as no gap or insulating glue layers need to be overcome any longer. The manufacturing of such a one-piece nozzle main body can also be done economically. So that good wear protection can also be achieved in the external part 6*a* of the draw-off nozzle funnel 6, the latter has also a wear-protective layer at least in the area of the yarn deflection zone indicated in FIG. 2 by a dotted line. Hard material or diamond coatings can be considered for this because they conduct heat well and can be applied relatively thinly. Heat conductivity is therefore not affected, not even by applying a wear-protective layer.

According to the preceding description, in the embodiment of FIG. 1, the ceramic insert 9 is lengthened to contain a part of the nozzle bore hole 11. At the same time, the ceramic insert 9 defined a wear-protective bushing 12 that connects to the draw-off nozzle funnel 6 inside the draw-off nozzle 1. As a result of this, the manufacturing and assembly of such a thread draw-off nozzle 1 is made especially easy and economical. Owing to the excellent heat dissipation from the thread contact zone undergoing the most strain, the ceramic insert 9 can be easily glued in or pressed into the draw-off nozzle main body.

Figure 4:
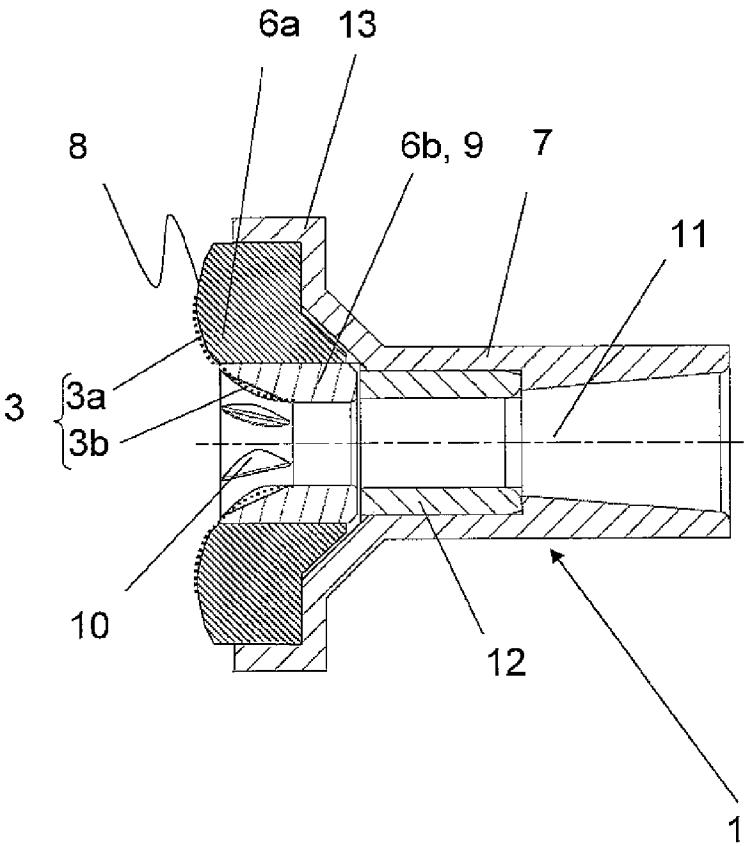

Contrary to this, the thread draw-off nozzle 1 seen in FIGS. 2 & 4 has a separate wear-protecting bushing 12 that can be executed either as a ceramic insert or steel insert and also be glued in or pressed into the nozzle main body. Even with this design, it is possible to optimally combine the advantages of the improved heat dissipation from the yarn deflection zone subject to the most strain with various structures 10 for influencing the twisting and moving of the yarn and good wear protection.

Contrary to the draw-off nozzle 1 of FIG. 2, the draw-off nozzle 1 of FIG. 4 still has—apart from the draw-off nozzle funnel 6 with its two parts 6*a* and 6*b*—a separate nozzle holder 13 connected here as one piece with the shaft 7.

FIG. 3 shows a draw-off nozzle 1 according to the invention in an execution as shaft-free nozzle. In this case, the draw-off nozzle 1 is fastened to the cover 2 of the rotor housing with a holder 13 that, as shown here, can also be executed as one piece with the external part 6*a* of the draw-off nozzle funnel. Here, a wear-protection bushing 12 can be also inserted directly in the cover 2.

The invention is not limited to the embodiments shown. Deviations and combinations within the framework of the patent claims also fall under the invention.

The invention claimed is:

1. A thread draw-off nozzle for an open-end spinning device, comprising:

a nozzle funnel, said nozzle funnel defining a yarn deflection zone disposed to deflect a yarn produced in the open-end spinning device during a yarn draw-off process;

said nozzle funnel formed as a two-part component having a radially outer external part defining a first area of said deflection zone, and a radially inner internal part defining a second area of said deflection zone;

said external part and said internal part of said nozzle funnel having different materials defining said first area and said second area, respectively, said different materials having different thermal or wear characteristics and, wherein said external part is formed of a metal in said first area of said deflection zone having a high thermal conductivity and said internal part is formed of a ceramic material in said second area of said deflection zone having a high wear resistance.

2. The thread draw-off nozzle as in claim 1, wherein said external part is formed entirely of said thermally conductive material and said internal part is formed entirely of said wear-resistant ceramic material.

3. The thread draw-off nozzle as in claim 1, wherein said internal part comprises a ceramic material coating in said second area of said deflection zone.

4. The thread draw-off nozzle as in claim 1, wherein said external part is formed from a material having a minimum thermal conductivity of 100 W/mK.

5. The thread draw-off nozzle as in claim 4, wherein said external part further comprises a wear-resistant layer over said material at least in said second area of said deflection zone.

6. The thread draw-off nozzle as in claim 1, further comprising one of a nozzle holder or nozzle shaft that secure said draw-off nozzle in the open-end spinning device, said external part defined as a one-part design with said nozzle holder or said nozzle shaft to define a nozzle main body.

7. The thread draw-off nozzle as in claim 6, wherein said internal part comprises a ceramic insert fitted into one of said external part, said nozzle holder, or said nozzle shaft.

8. The thread draw-off nozzle as in claim 7, wherein said ceramic insert comprises radially arranged macro structures in said second area of said deflection zone.

9. The thread draw-off nozzle as in claim 7, wherein said ceramic insert is glued into one of said external part, said nozzle holder, or said nozzle shaft.

10. The thread draw-off nozzle as in claim 6, wherein said nozzle main body defines a nozzle bore hole, said nozzle bore hole comprising a thermally conductive, wear-protective material layer.

11. The thread draw-off nozzle as in claim 10, wherein said thermally conductive, wear-protective material layer is a diamond coating material.

12. The thread draw-off nozzle as in claim 1, further comprising a wear protective bushing in said draw-off nozzle downstream of said nozzle funnel, said bushing formed from one of steel or ceramic.

13. The thread draw-off nozzle as in claim 12, wherein said internal part comprises a ceramic insert fitted into one of said external part, a nozzle holder, or a nozzle shaft, said bushing defined as a one-part design with said ceramic insert.

14. The thread draw-off nozzle as in claim 1, further comprising a transition point defined between said external part and said internal part, said transition point configured so as not to contact the withdrawn yarn in said deflection zone.

* * * * *